US008915638B2

(12) United States Patent
Gu et al.

(10) Patent No.: US 8,915,638 B2
(45) Date of Patent: Dec. 23, 2014

(54) BACKLIGHT MODULE AND DISPLAY APPARATUS

(75) Inventors: Yubo Gu, Guangdong (CN); Pei Jia, Guangdong (CN); Liuyang Yang, Guangdong (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 263 days.

(21) Appl. No.: 13/697,765

(22) PCT Filed: Jun. 1, 2012

(86) PCT No.: PCT/CN2012/076387

§ 371 (c)(1),
(2), (4) Date: Nov. 13, 2012

(87) PCT Pub. No.: WO2013/170503

PCT Pub. Date: Nov. 21, 2013

(65) Prior Publication Data

US 2013/0308297 A1 Nov. 21, 2013

(51) Int. Cl.

| | |
|---|---|
| ***F21V 7/04*** | (2006.01) |
| ***G09F 13/04*** | (2006.01) |
| ***G09F 13/14*** | (2006.01) |
| *G09F 13/22* | (2006.01) |

(52) U.S. Cl.

CPC ..... *G09F 13/04* (2013.01); *G09F 13/14* (2013.01); *G09F 2013/145* (2013.01); *G09F 2013/222* (2013.01)

USPC ..... 362/613; 362/609; 362/611; 362/632; 362/633

(58) Field of Classification Search

USPC ..... 362/97.1, 609, 611, 612, 613, 632, 633

See application file for complete search history.

(56) References Cited

U.S. PATENT DOCUMENTS

| | | | | |
|---|---|---|---|---|
| 8,243,231 | B2 * | 8/2012 | Hur et al. | 349/58 |
| 2013/0250203 | A1 * | 9/2013 | Zhou | 349/58 |

* cited by examiner

*Primary Examiner* — Diane Lee

*Assistant Examiner* — Meghan Dunwiddie

(74) *Attorney, Agent, or Firm* — Kirton McConkie; Evan R. Witt

(57) ABSTRACT

The present invention provides a backlight module and a display apparatus. The display apparatus comprises the backlight module and a display panel. The backlight module comprises a back bezel and a plurality of light sources. The back bezel includes a plurality of bezel convex portions and a plurality of corresponding bezel concave portions. The light sources are disposed on the back bezel and positioned between the bezel convex portions. The present invention can use the bezel concave portions of the back bezel to improve a heat-dissipation effect.

17 Claims, 4 Drawing Sheets

BACKLIGHT MODULE AND DISPLAY APPARATUS

FIELD OF THE INVENTION

The present invention relates to a backlight module and a display apparatus, and more particularly to a backlight module and a display apparatus capable of improving the heat dissipation efficiency thereof.

BACKGROUND OF THE INVENTION

Liquid crystal displays (LCDs) have been widely applied in electrical products. Currently, most LCDs are backlight type LCDs that comprise a liquid crystal panel and a backlight module. According to the position of the light sources for providing LCDs with backlight, the backlight module can be classified into a side-light type or a direct-light type.

A heat generated by the LCDs in a working status may deteriorate an efficiency thereof, thus the heat dissipation is very important to the LCDs. In the direct-light type backlight module, the light sources, such as light emitting diodes (LEDs), are disposed on a back bezel. However, the heat of the LEDs tends to be accumulated at a specific region of the backlight module, resulting in an uneven heat dissipation, as well as deteriorating a light efficiency of the LEDs and a display quality of the LCD.

As a result, it is necessary to provide a backlight module and a display apparatus to solve the problems existing in conventional technologies such as above-mentioned.

SUMMARY OF THE INVENTION

The present invention provides a backlight module and a display apparatus to solve a heat dissipation problem existing in a conventional backlight module.

A primary object of the present invention is to provide a backlight module, wherein the backlight module comprises: a back bezel having a first surface and a second surface opposite thereto, wherein the back bezel includes a plurality of bezel convex portions and a plurality of corresponding bezel concave portions, and the bezel convex portions are formed on the first surface and have obliquely reflective surfaces, and the bezel concave portions are formed on the second surface; and a plurality of light sources disposed on the first surface and positioned between the bezel convex portions.

A secondary object of the present invention is to provide a backlight module, wherein the backlight module comprises: a back bezel having a first surface and a second surface opposite thereto, wherein the back bezel includes a plurality of bezel convex portions and a plurality of corresponding bezel concave portions, and the bezel convex portions are formed on the first surface and have obliquely reflective surfaces, and the bezel concave portions are formed on the second surface; and a plurality of light sources disposed on the first surface and positioned between the bezel convex portions.

A further object of the present invention is to provide a display apparatus, wherein the display apparatus comprises a display panel and a backlight module. The backlight module comprises: a back bezel having a first surface and a second surface opposite thereto, wherein the back bezel includes a plurality of bezel convex portions and a plurality of corresponding bezel concave portions, and the bezel convex portions are formed on the first surface and have obliquely reflective surfaces, and the bezel concave portions are formed on the second surface; and a plurality of light sources disposed on the first surface and positioned between the bezel convex portions.

In one embodiment of the present invention, the obliquely reflective surfaces are obliquely flat surfaces or obliquely curved surfaces.

In one embodiment of the present invention, an included angle between the obliquely reflective surfaces and the back bezel is in a range of 135 degrees to 180 degrees.

In one embodiment of the present invention, the included angle between the obliquely reflective surfaces and the back bezel is in a range of 165 degrees to 180 degrees.

In one embodiment of the present invention, a height of the bezel convex portions is lower than a height of a top surface of the light sources.

In one embodiment of the present invention, at least portions of the bezel concave portions are positioned in a high-temperature region of a temperature distribution diagram of the back bezel, and the temperature distribution diagram is predetermined before forming the bezel concave portions on the back bezel.

In one embodiment of the present invention, the bezel convex portions are scattered convex portions in the shape of dots.

In one embodiment of the present invention, the backlight module further comprises a plurality of fluid channels for allowing a heat dissipation fluid to flow therein, wherein at least portions of the fluid channels are received in the bezel concave portions.

In one embodiment of the present invention, the fluid channels are U-shaped metal pipes, or connected as a continuous S-shaped metal pipe.

In comparison to the conventional backlight module having a heat concentration problem, with the use of the backlight module and the display apparatus of the present invention, the heat dissipation area in a partial region of the back bezel can be increased for efficiently dissipating the heat of the light source according to the positions of the light sources. Therefore, the heat-dissipation effect of the backlight module and the display apparatus of the present invention can be improved, thus homogenizing the temperature distribution and enhancing the display quality of the display apparatus. In addition, with the use of the obliquely reflective surfaces of the bezel convex portions, the light reflection between the light sources can be improved, so as to mitigate the uneven light distribution problem between the light sources, thereby enhancing a light distribution uniformity of the backlight module.

The structure and the technical means adopted by the present invention to achieve the above-mentioned and other objects can be best understood by referring to the following detailed description of the preferred embodiments and the accompanying drawings:

DETAILED DESCRIPTION OF THE PREFERRED EMBODIMENTS

Figure 1:
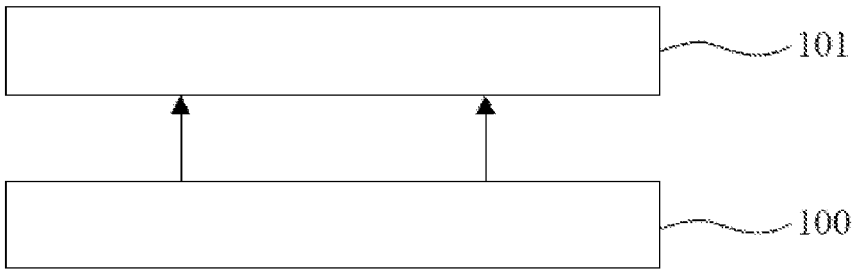
FIG. 1 is a schematic diagram showing a display apparatus according to one embodiment of the present invention.

The following embodiments are exemplified by referring to the accompanying drawings, for describing specific embodiments implemented by the present invention. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

In the drawings, like reference numerals indicate like components or items.

Figure 2A:
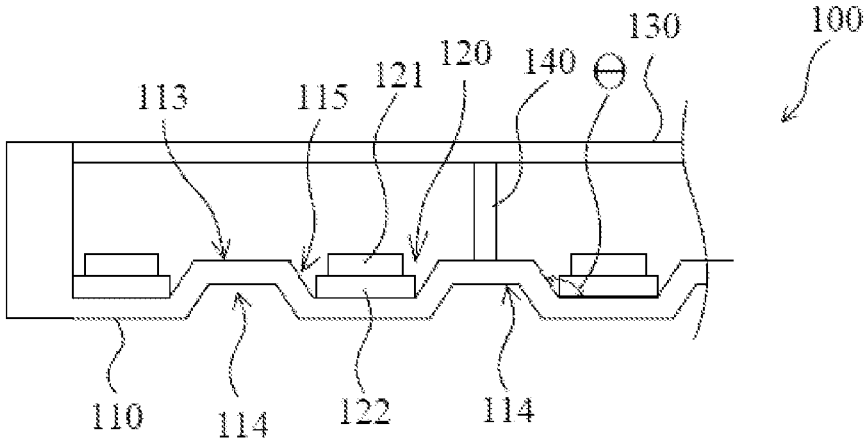
FIG. 2A is partially cross-sectional view showing a backlight module according to one embodiment of the present invention.
Figure 2B:
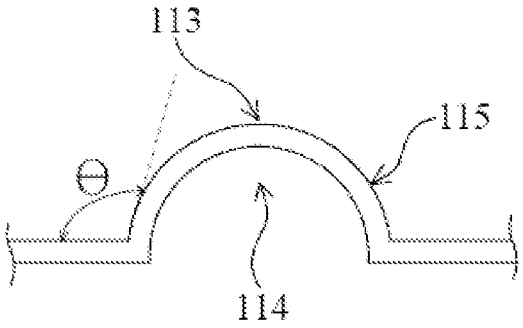
FIG. 2B and FIG. 2C are partially cross-sectional views showing the back bezel according to one embodiment of the present invention.
Figure 2C:
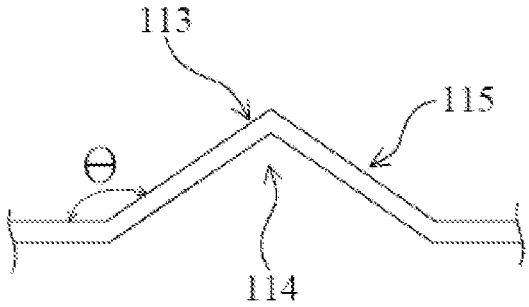

Referring to FIG. 1 and FIG. 2A, FIG. 1 is a schematic diagram showing a display apparatus according to one embodiment of the present invention, and FIG. 2A is partially cross-sectional view showing a backlight module according to one embodiment of the present invention. In the present embodiment, the backlight module 100 may be a direct-light type backlight module and disposed opposite to a display panel 101 (such as a liquid crystal display panel), thereby forming the display apparatus (such as an LCD apparatus). The backlight module 100 can comprise a back bezel 110, a plurality of light sources 120, at least one optical film 130 and a plurality of supporting pillars 140. The light sources 120 are disposed on the back bezel 110 for emitting light to the display panel 101. The at least one optical film 130 is disposed above the light sources 120 for improving the light uniformity and the light emitting efficiency thereof. The supporting pillars 140 are disposed on the back bezel 110 for supporting the optical film 130 above the light sources 120.

Figure 3:
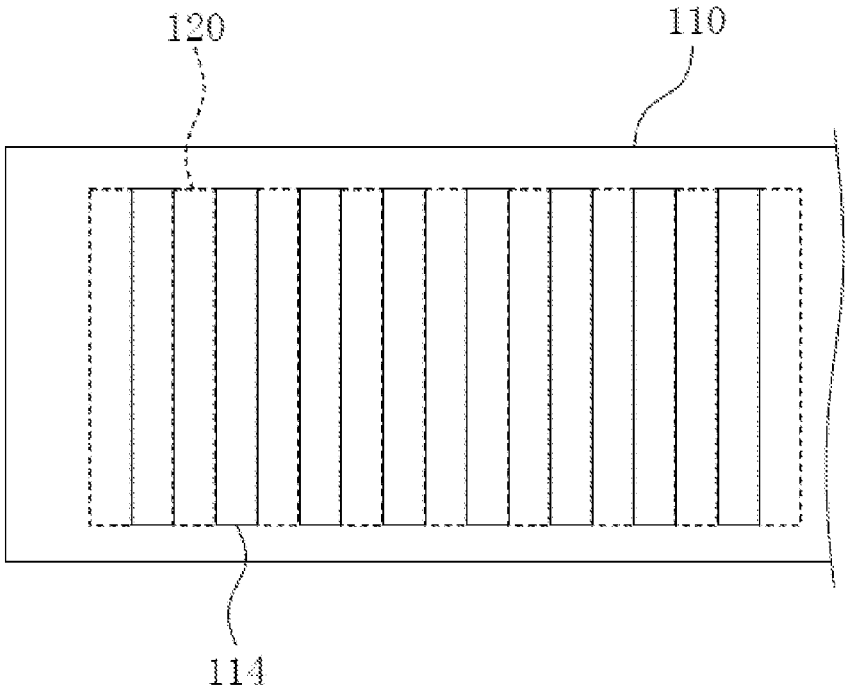
FIG. 3 is a bottom view showing the back bezel according to one embodiment of the present invention.

Referring to FIG. 2A through FIG. 3, FIG. 2B and FIG. 2C are partially cross-sectional views showing the back bezel according to one embodiment of the present invention, and FIG. 3 is a bottom view showing the back bezel according to one embodiment of the present invention. The back bezel 110 of the present embodiment may be made of an opaque material, such as plastic, metal or any combination material thereof. The material of the back bezel 110 is preferably a metal of a great thermal conductivity, such as Al. The back bezel 110 has a first surface 111 and a second surface 112 opposite thereto, wherein the back bezel 110 includes a plurality of bezel convex portions 113 and a plurality of corresponding bezel concave portions 114. The bezel convex portions 113 are formed on the first surface 111, and the bezel concave portions 114 are formed on the second surface 112 (the rear surface) for increasing a heat dissipation area of the back bezel 110, thereby improving a heat dissipation effect of the back bezel 110. The bezel convex portions 113 and the corresponding bezel concave portions 114 may be formed as one-piece together with the back bezel 110 by extrusion molding, stamping, cutting, casting, machining, compression molding or forging. The bezel convex portions 113 may have various cross-sectional shapes, such as an arc, a triangle, a rectangle or any other shapes. In this embodiment, the bezel convex portions 113 may be elongated convex portions. At least portions of the convex portions 113 are positioned in a high-temperature region of a temperature distribution diagram of the back bezel 110. The temperature distribution diagram is predetermined before forming the bezel convex portions 113 on the back bezel 110 for realizing the heat distribution of the back bezel 110. In general, the temperature in the high-temperature region is substantially greater than an average temperature of the back bezel 110 in working. The average temperature is an average of the highest temperature and the lowest temperature of the back bezel 110 in working. Therefore, the bezel concave portions 114 (the bezel convex portions 113) can be only arranged on a partial region (the high-temperature region) to mitigate the heat concentration problem. However, in some embodiments, the bezel concave portions 114 can be arranged on the entire region of the second surface 112 of the back bezel 110 but not limited to the above description.

Referring to FIG. 1 again, the light sources 120 may be light emitting diodes (LEDs), organic light emitting diodes (OLED), cold cathode fluorescent lamps (CCFL), electroluminescence (EL) devices or light bars. In this embodiment, the light sources 120 may be LED light bars arranged on the first surface 111 of the back bezel 110. Each of the LED light bars may be composed of a plurality of LED chips 121 and a circuit broad 122 (such as a printed circuit board), wherein the LED chips 121 can be disposed on the circuit broad 122 for lighting.

In this embodiment, referring to FIG. 2A again, each of the bezel convex portions 113 has obliquely reflective surfaces 115. The obliquely reflective surfaces 115 are formed on side surfaces of the bezel convex portions 113 for reflecting light rays between the light sources 120 toward the liquid crystal display panel 101, so as to increase the light output intensity in the spaces between the light sources 120. Thus, the light intensity of the light sources 120 can be distributed more evenly, so as to mitigate an uneven light distribution problem between the light sources 120, i.e. the hot spot problem between the light sources 120. In addition, the obliquely reflective surfaces 115 of the bezel convex portions 113 can be obliquely flat surfaces or obliquely curved surfaces. An included angle θ between the obliquely reflective surfaces 115 of bezel convex portions 113 and the back bezel 110 (the first surface 111) is in a range of 135 degrees to 180 degrees, such as in a range of 165 degrees to 180 degrees or in a range of 135 degrees to 157.5 degrees, so as to effectively reflect the light rays between the light sources 120 toward the liquid crystal display panel 101 for mitigating the hot spot problem of the backlight module 100. In this case, a height of the bezel convex portions 130 is preferably lower than a height of a top surface (such a light emitting surface of the LED chips 121) of the light sources 120, so as to enhance the light output intensity between the light sources 120.

Referring to FIG. 2A again, the at least one optical film 130 of the present embodiment may be a diffuser, a prism sheet, a brightness enhancement film, a dual brightness enhancement film, a diffused reflective polarizer film or any combination thereof, and disposed above the at least one light source 120.

Referring to FIG. 2A again, the supporting pillars 140 of the present embodiment are disposed on the first surface 111 for supporting the at least one optical film 130, thereby mitigating the deflection problem of the optical film 130 resulting from a weight thereof. The supporting pillars 140 can be formed on the back bezel 110 as one piece. However, the forming of the supporting pillars 140 is not limited to this. The supporting pillars 140 can also be disposed on the back bezel 110 by welding, bonding or screwing.

Referring to FIG. 2A again, a highly reflective material can be formed or coated on the inner surface (including the surface of the bezel convex portions 113) of the back bezel 110 to form a reflective layer (not shown). The highly reflective material may be Au, Ag, Al, Au, Cr, Cu, In, Ir, Ni, Pt, Re, Rh, Sn, Ta, W, Mn, white paint with etiolation-resistant and heat-resistant properties or any combination thereof, for reflecting light rays.

In the present embodiment, a shape, density, or quantity of the arrangement of the bezel concave portions 114 of the back bezel 110 can be determined according to the temperature distribution of the backlight module 100. After the positions of the light sources 120 at the back bezel 110 is determined and the light sources 120 have worked for a predetermined time, the backlight module 100 can have a specific heat distribution (temperature distribution diagram). For example, in a direct-light type backlight module, the heat of light sources tends to be accumulated in a center region. Therefore, in this embodiment, the bezel concave portions 114 can be arranged in a center region of the back bezel 110 corresponding to the heat concentration region of the back bezel 110 (the high-temperature region of the temperature distribution diagram), so as to increase the heat dissipation area of a center region of the back bezel 110, thereby improving the heat dissipation of the back bezel 110, as well as homogenizing the temperature distribution thereof. However, according to the heat distribution of the backlight module 100, the bezel concave portions 114 may be arranged in other regions but not limited to the above-mentioned description.

When the light sources 120 of the backlight module 100 provide the backlight for the display panel 101, due to the bezel concave portions 114 formed on the rear surface of the back bezel 110 and close to the light sources 120, the heat-dissipation effect which is formed close to the light sources 120 can be improved to prevent the heat concentration of the light sources 120 and to enhance a the display quality of the display apparatus. Moreover, with the use of the obliquely reflective surfaces 115 of the bezel convex portions 113, the light reflection between the light sources 120 can be improved, so as to mitigate the uneven light distribution problem between the light sources 120.

Figure 4:
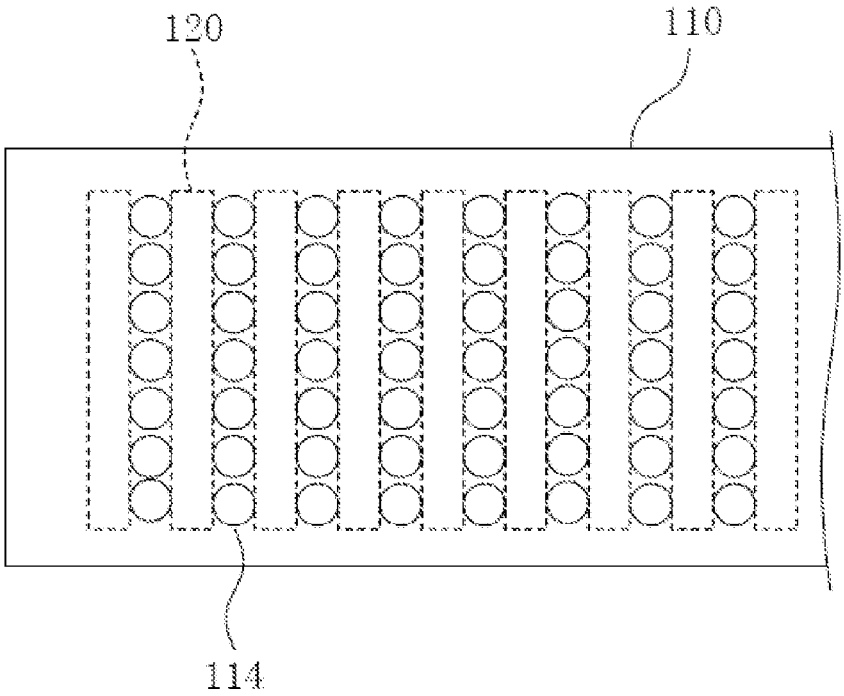
FIG. 4 is a bottom view showing a back bezel according to another embodiment of the present invention.

Referring to FIG. 4, a bottom view showing a back bezel according to another embodiment of the present invention is illustrated. In another embodiment, the bezel concave portions 214 of the back bezel 110 may be scattered concave portions in the shape of dots, and the bezel convex portions may be scattered convex portions in the shape of dots. The bezel concave portions 214 can be arranged in the heat concentration region and positioned between the light sources 120 for increasing the heat-dissipation area of the back bezel 110, thus improving the heat-dissipation effect as well as homogenizing the temperature distribution of the back bezel 110.

Figure 5:
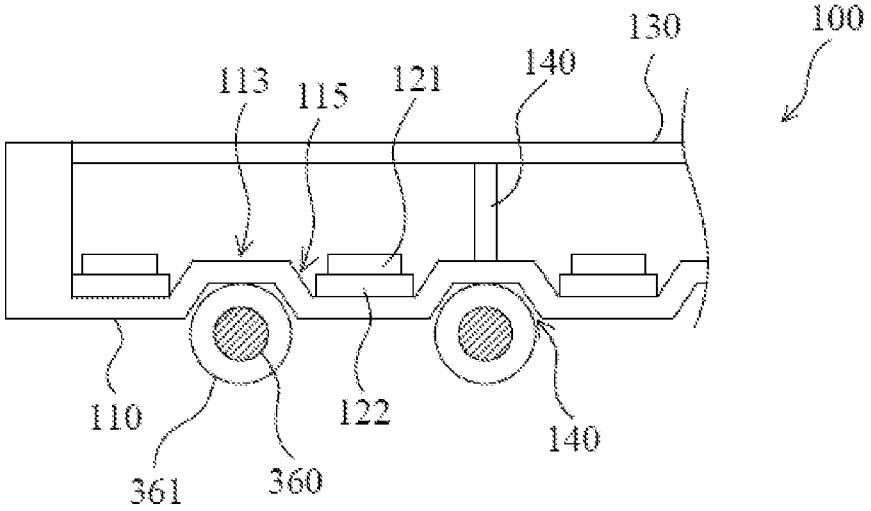
FIG. 5 is a partially cross-section view showing a backlight module according to a further embodiment of the present invention.

Referring to FIG. 5, a partially cross-section view showing a backlight module according to a further embodiment of the present invention is illustrated. In the further embodiment, the backlight module 100 further comprises a plurality of fluid channels 360 for allowing a heat dissipation fluid 361 to flow therein, so as to transmit the heat of the back bezel 110 and to homogenize the temperature distribution of the back bezel 110. At this time, the bezel concave portions 114 of the back bezel 110 can be elongated concave portions, and at least portions of the fluid channels 360 are received in the bezel concave portions 114. The fluid channels 360 may be U-shaped metal pipes, or connected as a continuous S-shaped metal pipe. The heat dissipation fluid 361 may be gas (such as air, N2, H2, He or Ar) or liquid (such as water or cooling agency) which flows under a predetermined pressure. That is, there is a pressure difference between the inlets and the outlets of the fluid channels 360. The predetermined pressure may be formed by a pressuring device, such as a pump (not shown). If necessary, both ends of each two adjacent fluid channels 360 can be connected to each other by suitable way, thereby forming an S-shaped circulatory system. Therefore, the heat dissipation fluid 361 can flows in the heat dissipation plate to perform the heat exchange process, the heat dissipation efficiency can be significantly improved in the limited space. Furthermore, the deformation problem due to uneven temperature distribution can be mitigated effectively.

As described above, in the backlight module and the display apparatus of the present invention, the heat dissipation area can be enlarged by the c bezel concave portions of the back bezel. Furthermore, the arrangement of the bezel concave portions is determined according to the position of the light source for efficiently dissipating the heat thereof as well as mitigating the heat concentration problem thereof. In addition, with the use of the obliquely reflective surfaces of the bezel convex portions, the light reflection between the light sources can be improved, so as to mitigate the uneven light distribution problem between the light sources, thereby enhancing a light distribution uniformity of the backlight module.

The present invention has been described with a preferred embodiment thereof and it is understood that many changes and modifications to the described embodiment can be carried out without departing from the scope and the spirit of the invention that is intended to be limited only by the appended claims.

The invention claimed is:

1. A backlight module, comprising:

a back bezel having a first surface and a second surface opposite thereto, wherein the back bezel includes a plurality of bezel convex portions and a plurality of corresponding bezel concave portions, and the bezel convex portions are formed on the first surface and have obliquely reflective surfaces, and the bezel concave portions are formed on the second surface, and an included angle between the obliquely reflective surfaces and the back bezel is in a range of 135 degrees to 180 degrees; and a plurality of light sources disposed on the first surface and positioned between the bezel convex portions, wherein a height of the bezel convex portions is lower than a height of a top surface of the light sources.

2. The backlight module according to claim 1, wherein the obliquely reflective surfaces are obliquely flat surfaces or obliquely curved surfaces.

3. The backlight module according to claim 1, wherein the included angle between the obliquely reflective surfaces and the back bezel is in a range of 165 degrees to 180 degrees.

4. The backlight module according to claim 1, wherein at least portions of the bezel concave portions are positioned in a high-temperature region of a temperature distribution diagram of the back bezel, and the temperature distribution diagram is predetermined before forming the bezel concave portions on the back bezel.

5. The backlight module according to claim 1, wherein the bezel convex portions are scattered convex portions in the shape of dots.

6. The backlight module according to claim 1, further comprising a plurality of fluid channels for allowing a heat dissipation fluid to flow therein, wherein at least portions of the fluid channels are received in the bezel concave portions.

7. The backlight module according to claim 6, wherein the fluid channels are U-shaped metal pipes, or connected as a continuous S-shaped metal pipe.

8. A backlight module, comprising:

a back bezel having a first surface and a second surface opposite thereto, wherein the back bezel includes a plurality of bezel convex portions and a plurality of corresponding bezel concave portions, and the bezel convex portions are formed on the first surface and have obliquely reflective surfaces, and the bezel concave portions are formed on the second surface; and a plurality of light sources disposed on the first surface and positioned between the bezel convex portions.

9. The backlight module according to claim 8, wherein the obliquely reflective surfaces are obliquely flat surfaces or obliquely curved surfaces.

10. The backlight module according to claim 8, wherein an included angle between the obliquely reflective surfaces and the back bezel is in a range of 135 degrees to 180 degrees.

11. The backlight module according to claim 10, wherein the included angle between the obliquely reflective surfaces and the back bezel is in a range of 165 degrees to 180 degrees.

12. The backlight module according to claim 8, wherein a height of the bezel convex portions is lower than a height of a top surface of the light sources.

13. The backlight module according to claim 8, wherein at least portions of the bezel concave portions are positioned in a high-temperature region of a temperature distribution diagram of the back bezel, and the temperature distribution diagram is predetermined before forming the bezel concave portions on the back bezel.

14. The backlight module according to claim 8, wherein the bezel convex portions are scattered convex portions in the shape of dots.

15. The backlight module according to claim 8, further comprising a plurality of fluid channels for allowing a heat dissipation fluid to flow therein, wherein at least portions of the fluid channels are received in the bezel concave portions.

16. The backlight module according to claim 15, wherein the fluid channels are U-shaped metal pipes, or connected as a continuous S-shaped metal pipe.

17. A display apparatus, comprising:

a display panel; and a backlight module comprising:

a back bezel having a first surface and a second surface opposite thereto, wherein the back bezel includes a plurality of bezel convex portions and a plurality of corresponding bezel concave portions, and the bezel convex portions are formed on the first surface and have obliquely reflective surfaces, and the bezel concave portions are formed on the second surface; and a plurality of light sources disposed on the first surface and positioned between the bezel convex portions.

* * * * *